United States Patent [19]

Pape

[11] Patent Number: 4,677,951

[45] Date of Patent: Jul. 7, 1987

[54] FUEL INJECTION PUMP

[75] Inventor: Werner Pape, Magstadt, Fed. Rep. of Germany

[73] Assignee: Robert Bosch GmbH, Stuttgart, Fed. Rep. of Germany

[21] Appl. No.: 804,195

[22] Filed: Dec. 3, 1985

[30] Foreign Application Priority Data

Jan. 17, 1985 [DE] Fed. Rep. of Germany ..... 3501379

[51] Int. Cl.[4] ..... F02D 41/40

[52] U.S. Cl. ..... 123/357; 123/494

[58] Field of Search ..... 123/357, 449, 450, 494, 123/458, 501; 73/119 A

[56] References Cited

U.S. PATENT DOCUMENTS

| | | | |
|---|---|---|---|
| 4,036,193 | 7/1977 | Kobayashi et al. | 123/357 |
| 4,531,491 | 7/1985 | Iiyama et al. | 123/357 |
| 4,538,580 | 9/1985 | Straubel et al. | 123/494 |

*Primary Examiner*—Tony M. Argenbright

*Attorney, Agent, or Firm*—Edwin E. Greigg

[57] ABSTRACT

A fuel injection pump is proposed having a rotating distributor, which is axially adjusted by an electromagnetic final control element counter to the force of a restoring spring. The force of the restoring spring is transmitted via an intermediate ring onto a collar of an armature serving as a coupling element, with the armature being provided with an axial recess into which a fitting part of the core of the electromagnet can plunge when magnetic force is applied.

11 Claims, 3 Drawing Figures

FUEL INJECTION PUMP

BACKGROUND OF THE INVENTION

The invention is based on a fuel injection pump as generically defined hereinafter. In a fuel injection pump of this type, known from German Offenlegungsschrift No. 32 43 348, the distributor has a bolt mounted on it, which serves as an armature and is displaceable inside a magnetic coil; a restoring spring acts on the other end of the distributor, and the movable portion of a transducer, in the form of a sheetmetal strip having an oblique control edge is mounted on that end of the distributor as well. In addition to this movable transducer portion, there is a stationary transducer portion and an expensive electrical evaluation device. This travel transducer provided in the known fuel injection pump serves to trigger a control pulse for a metering magnetic valve; with the aid of the travel transducer, the relative rotation of the distributor is detected. Thus the transducer does not provide a direct signal for the axial position of the distributor, but only an indirect signal of this position for the purpose of directly controlling the metering timing.

OBJECT AND SUMMARY OF THE INVENTION

The fuel injection pump according to the invention has the advantage over the prior art that reliable adjustment of the movable portion of a travel transducer can be effected to determine the actual axial position of the distributor, and at the same time a space-saving electromagnetic final control element is obtained. The space required in the axial direction, in particular, is kept small, and the magnetic resistance of the secondary air gap between the collar on the coupling part and the outer housing of the electromagnetic final control element is reduced, which assures that the final control element will operate very efficiently.

In particular the structure saves space in the axial direction because the portion of the armature that acts to effect adjustment is arranged concentrically with the central core of the electromagnet, which moves into the recess when the distributor shifts. The rotary motion transmitted onto the armature by the distributor advantageously lessens hysteresis in the adjustment process, because the considerable influence of static friction is thereby eliminated. The rotation can produce only sliding friction, which is further reduced by flushing the space receiving the armature with fuel. This fuel additionally acts as a damping medium, if the depth to which the central core plunges into the recess is varied. The compression spring disposed between the intermediate ring and the housing of the electromagnet is located such that it is easily accessible. The concept revealed herein is also favorable for increasing the efficiency of the electromagnet because with it the magnetic resistance is decreased. In one of the embodiments disclosed, a desired adjustment characteristic is attainable at little expense. In a particularly advantageous fashion, another embodiment provides a space-saving structure, which is also favorable in terms of the travel transducer actuation because the mass of the structure is low.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
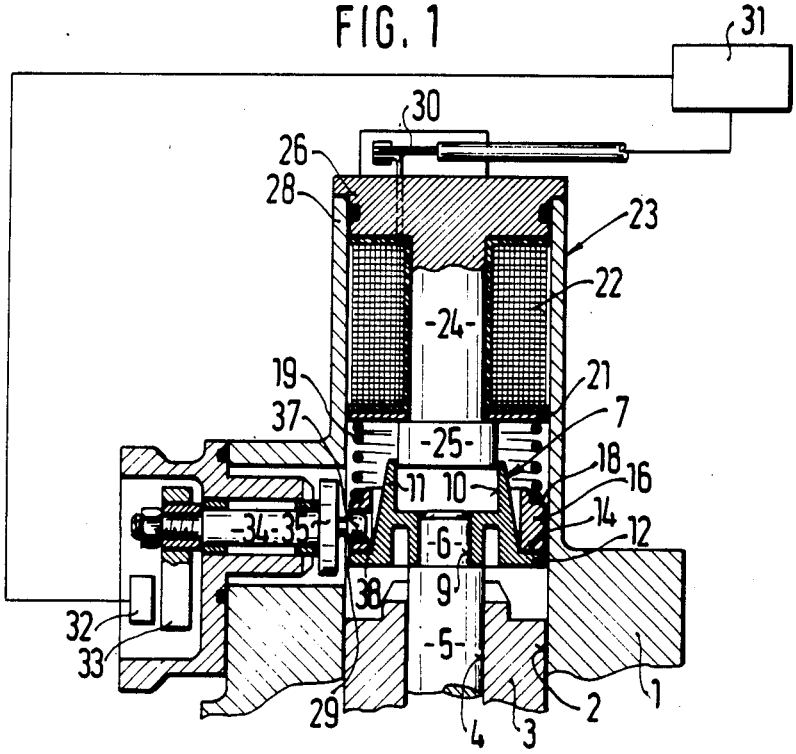
FIG. 1 shows a first exemplary embodiment of the invention in a section taken through the portion of a fuel injection pump that is essential to the invention, having a cup-shaped armature.

In the drawing in FIG. 1, only the upper portion of a fuel injection pump of the distributor type is shown, having a housing 1, into which a bushing 3 is pressed into a bore 2; the bushing 3 has a through bore 4, inside which a distributor 5 is supported. This is a distributor of the type also described in German Offenlegungsschrift No. 32 43 348. This distributor is longitudinally displaceable and it is driven in rotation by means not shown here. On the end protruding out from the bushing 3, a cup-shaped armature 7 is mounted on a stub portion 6 of the distributor, for instance being shrunk-fit onto the stub to provide a rotationally secure mounting. The armature is rotationally-symmetrically shaped, having an axial bore 9 for receiving the stub portion 6 and a circular-cylindrical recess 10 coaxially adjacent to the recess 9. The wall 11 surrounding the recess 10 becomes wider as it descends toward the stub portion. At its outer circumference, the armature has a collar 12 with a flat, supporting annular end face 14 pointing axially away from the bushing 3. An intermediate ring 16 is mounted on this annular end face 14, forming with it a slide bearing and on its opposite end face 18 which forms a support for a compression spring 19, the spring is supported against an end-located annular cover plate 21 of the coil body 22 of an electromagnet 23. This magnet is part of an electromagnetic final control element, having a central core 24, located coaxially with the axis of the distributor 5 and armature 7, said core being adapted to completely fill the cylindrical interior of the coil body 22 and protrude toward the armature 7 with a circular-cylindrical fitting part 25 which is adapted to fit the recess 10. From the opposite end, the central core 24 merges with an end-located yoke 26 and furnishes the magnetic flux via a magnetically conductive outer jacket 28 of the electromagnet. The outer jacket is circular-cylindrical at least on its inside; it protrudes beyond the coil body 22 in the axial direction and surrounds the armature from which it is slightly spaced apart, forming an air gap 29. This air gap is also maintained by the intermediate ring 16 and over the entire axial adjusting length of the armature and intermediate ring.

The coil of the coil body 22 is supplied with electric current by a control unit 31 via supply leads 30. The control unit 31 receives feedback signals from a travel transducer 32 not described in further detail here, the movable portion 33 of which is mounted on the end of a shaft 34, which is supported in the housing of the fuel injection pump and has a crank disk 35 on its other end. A coupling member 37 is seated on the crank disk 35, eccentrically with the axis of the shaft, and engages a recess 38 of the cylindrical wall of the intermediate ring 16.

Depending on how the electromagnetic final control element is triggered by the control unit, the electromagnet 23 generates a variably large magnetic force, which draws the armature 7 onto the fitting part 25. This force acts counter to the restoring force of the compression spring 19, which is supported on the intermediate ring 16 and keeps ring 16 on its seat on the annular end face 14. The intermediate ring thus makes every axial movement the armature makes and transmits it via the shaft 34 onto the movable portion 33 of the travel transducer 32. Depending on the electrical current intensity, the fitting part 25 plunges to a variable depth into the recess 10, during which the magnetic flux to the wall 11 extends via the air gap formed by the play between the fitting part and the recess. In the exemplary embodiment described, the magnetic conductance increases with increasing plunge depth, because of the increasing wall thickness. The choice of wall thickness can be used here to modify the force of the magnet, as well as to establish a selected adjustment characteristic in relation to the current intensity applied to the magnet. The magnetic flux continues via the collar 12, and optionally via the intermediate ring 16 as well, to the outer jacket 38 of the electromagnet which surrounds these parts. Here again, the magnetic resistance can be kept small if there is a small air gap and a large transmission surface area on the outer jacket. In an advantageous manner, the space receiving the armature is flushed with fuel in a manner not shown here, thereby attaining not only cooling of the electromagnet but also a reduction of friction between parts in contact with one another and the slide bearing. Filling the recess 10 with fuel also serves as a damping element, which counteracts oscillating fluctuations in the position of the distributor. The rotational movement of the armature also lessens hysteresis during an adjustment, because during operation only sliding friction can arise; thus static friction, with its increased friction factor, is precluded.

Transmitting the axial adjustment of the distributor 5 to the movable portion 33 of the travel transducer 32 with the aid of the sliding intermediate ring can also be attained in an embodiment in which the distributor is moved with increasing adjusting force away from the final control element, with the aid of a correspondingly modified electromagnetic final control element. The advantage is that the bearing and adjusting surface is large, so that when this provision is used together with fuel flushing, friction losses and wear at the point where the restoring force is exerted can be kept low.

Figure 2:
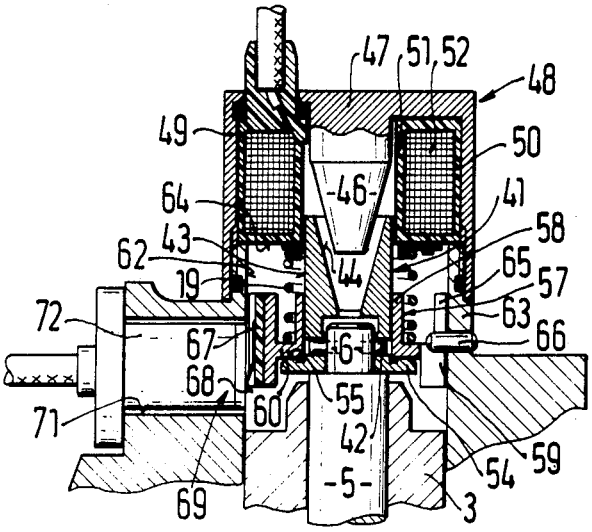
FIG. 2 shows a second exemplary embodiment, having a modified travel transducer embodiment.

A particularly advantageous articulation of the travel transducer on the intermediate ring is shown in the embodiment of FIG. 2. Here again only the upper part of a fuel injection pump, of the same type as in FIG. 1, is shown. In this embodiment, an armature 41 is mounted on the stub portion 6 of the distributor 5 and is secured there with a fastening pin 42. The armature 41 has a circular-cylindrical outer jacket 43 and a frustoconical coaxial recess 44, the tip of which points toward the stub portion 6. Protruding into this recess is a correspondingly frustoconical part 46 of the core 47 of an electromagnet 48. The core 47 merges with a cylindrical outer jacket 49, and a circular-annular, cylindrical coil body 50 is disposed between the outer jacket 49 and the core 47. The inner cylinder 51 of the coil body 50 extends approximately to the end of the frustoconical part 46 of the magnetic core. The armature 41 is fitted into the diameter of the inner cylinder 51, and when the magnetic coil 52 disposed inside the coil body 50 is provided with electric current, the armature 41 is drawn into the inner cylinder 51, toward the opposite pole represented by the frustoconical part 46.

On its lower end oriented toward the distributor 5, the armature 41 has a collar 54 with a flat annular end face 55 pointing axially away from the distributor 5. An intermediate ring 57 is mounted on this end face 55 and comprises an inner sleeve 58, which is guided by the cylindrical outer jacket 43 of the armature 41, an outer sleeve 59, and a crosspiece 60 joining the two sleeves. The intermediate ring 57 rests with the crosspiece 60 on the annular end face 55, and the outer jacket of the outer sleeve 59 slides in a cylindrical recess 62 of the housing 1 of the fuel injection pump. The part 63 of the housing 1 that has the cylindrical recess 62 is joined to the outer jacket 49 in a magnetically conductive manner and serves to receive the electromagnet. The compression spring 19 is fastened between the crosspiece 60 of the intermediate ring 57 and the axial end face 64 of the coil body 50 and keeps the intermediate ring on the annular end face 55 regardless of the position of the distributor 5. The intermediate ring 57 has an anti-torsion means in the form of a longitudinal slit 65, which is constantly engaged by a pin 66 inserted radially into the part 63 of the housing, regardless of the axial position of the intermediate ring.

Thus far the intermediate ring 57 corresponds entirely with the intermediate ring 16 of FIG. 1, except that it has a separate anti-torsion means and is guided more accurately, with the aid of the inner sleeve. By means of the outer sleeve 59, the magnetic flux is also advantageously conducted with low loss from the armature 41 to the outer jacket 49.

Figure 3:
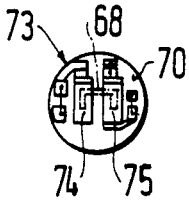
FIG. 3 is a plan view on the portion of the apparatus that bears the stationary portion of the travel transducer of FIG. 2.

Deviating now from the exemplary embodiment of FIG. 1, however, an insulating piece 67 having a wiper 68 is attached to the outer jacket of the outer sleeve 59. The wiper 68 is the movable part of a travel transducer 67, the stationary portion of which is disposed on the end face 70 of a carrier 72 inserted into a radial bore 71 of the housing 1. In the bore, the carrier is adjustable by conventional, known means with respect to the movable part 68 of the travel transducer. The stationary portion 73 of the travel transducer comprises a resistance track 74 and a contact track 75, which are overlappingly contacted by the wiper 68 (see FIG. 3). The contact track and resistance track are provided in a known manner with electrical connections which extend through the carrier 72 to the outside.

In addition to the advantages described in conjunction with FIG. 1, this second embodiment has the further advantages that the intermediate ring is accurately guided, that an optimal magnetic flux is attained because of the slight wall spacing between the intermediate ring and the armature, on the one hand, and between the intermediate ring and the housing part 63 on the other, and that furthermore the travel signal for detecting the axial position of the distributor can be attained in a space-saving manner, with little mass. The apparatus described has a compact structure and a small number of movable parts.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection pump having a housing comprising, a rotary distributor for determining injection duration and for injection timing, said rotary distributor positioned in a bore in said housing, an associated electromagnetic final control element and a control unit therefor, said electromagnetic final control element arranged to adjust said distributor counter to a restoring force, a transducer for detecting the axial position of said distributor, said transducer being connected to said electric control unit, means firmly joined to one end of said distributor, said means having an outer circumference including a collar, an intermediate ring supported on said collar, spring means urging said intermediate ring against said collar and means carried by said intermediate ring, said last named means adapted to transmit signals to said transducer.

2. A fuel injection pump as defined by claim 1, in which said final control element has a coil body, a core adapted to protrude axially of said distributor from said coil body, said means firmly connected to said distributor comprising an armature and said armature having a recess adapted to receive a means on said core.

3. A fuel injection pump as defined by claim 2, in which said armature has a wall which varies in thickness over at least a portion of a zone lying between a mouth of said recess and said collar, said wall thickness being selectable to vary electrical adjustment characteristics thereof.

4. A fuel injection pump as defined by claim 2, in which said electromagnetic final control element includes a magnetically conductive outer jacket which surrounds said armature, said jacket adapted to extend over the entire adjustment range of said armature.

5. A fuel injection pump as defined by claim 3, in which said final control element has a coil body, a core adapted to protrude axially of said distributor from said coil body, said means firmly connected to said distributor comprising an armature and said armature having a recess adapted to receive a means on said core.

6. A fuel injection pump as defined by claim 1, in which said transducer further includes a movable and a stationary part and a coupling surface on said intermediate ring, said coupling surface being engaged by a coupling element joined to one of said parts of said position transducer.

7. A fuel injection pump as defined by claim 2, in which said transducer further includes a movable and a stationary part and a coupling surface on said intermediate ring, said coupling surface being engaged by a coupling element joined to one of said parts of said position transducer.

8. A fuel injection pump as defined by claim 6, in which said coupling part is secured at an end of a stationarily-supported lever and further that said coupling part simultaneously serves as a means for securing said intermediate ring against torsion.

9. A fuel injection pump as defined by claim 1, in which said means firmly joined to one end of said distributor is an armature of said final control element and further that said transducer has a movable element and a stationary element and of these elements, one element is secured directly on said intermediate ring and the other element is secured on an adjustable carrier which is inserted radially into said housing in proximity to said distributor.

10. A fuel injection pump as defined by claim 2, in which said means firmly joined to one end of said distributor is an armature of said final control element and further that said transducer has a movable element and a stationary element and of these elements, one element is secured directly on said intermediate ring and the other element is secured on an adjustable carrier which is inserted radially into said housing in proximity to said distributor.

11. A fuel injection pump as defined by claim 2, in which said armature cooperates with said core of said electromagnetic final control element, and further that said intermediate ring is adapted to adjoin a cylindrically embodied, magnetically conductive wall, which is in magnetically conductive contact with said core.

* * * * *